US009423230B1

(12) United States Patent
Foley et al.

(10) Patent No.: US 9,423,230 B1
(45) Date of Patent: Aug. 23, 2016

(54) METHOD AND APPARATUS FOR DISABLING A BLASTING CAP

(71) Applicant: EMERGING SCIENCE AND TECHNOLOGIES GROUP, INC., Boonsboro, MD (US)

(72) Inventors: Joseph William Foley, Woodsboro, MD (US); Wesley Stephen Estes, Frederick, MD (US); Walter Siering, Damascus, MD (US)

(73) Assignee: EMERGING SCIENCE AND TECHNOLOGIES GROUP, INC., Boonsboro, MD (US)

( * ) Notice: Subject to any disclaimer, the term of this patent is extended or adjusted under 35 U.S.C. 154(b) by 451 days.

(21) Appl. No.: 13/856,133

(22) Filed: Apr. 3, 2013

Related U.S. Application Data

(62) Division of application No. 12/748,040, filed on Mar. 26, 2010, now Pat. No. 8,430,011.

(60) Provisional application No. 61/202,682, filed on Mar. 26, 2009.

(51) Int. Cl.
*F42D 5/04* (2006.01)
*F41H 13/00* (2006.01)

(52) U.S. Cl.
CPC ..... *F42D 5/04* (2013.01); *F41H 13/0093* (2013.01)

(58) Field of Classification Search
CPC ..... F42D 5/04; F42B 33/06; F41H 13/00; F41H 13/0093
USPC ..... 102/202.5, 202.7, 207, 215, 402, 293; 89/1.1, 1.13, 1.11; 86/50
See application file for complete search history.

(56) References Cited

U.S. PATENT DOCUMENTS

| | | | | |
|---|---|---|---|---|
| 7,051,636 | B1 * | 5/2006 | Snow | F41H 13/0075 250/341.1 |
| 7,130,624 | B1 * | 10/2006 | Jackson | F41H 13/0075 455/420 |
| 7,296,503 | B1 * | 11/2007 | McGrath | F41H 11/32 102/402 |
| 7,318,368 | B2 * | 1/2008 | Ham | H04K 3/42 89/1.11 |
| 7,334,523 | B2 * | 2/2008 | Lucas | F42B 3/18 102/202.7 |
| 7,512,511 | B1 * | 3/2009 | Schultz | F41H 13/0068 250/250 |
| 7,775,145 | B2 * | 8/2010 | Bitar | F42B 33/06 102/403 |
| 7,775,146 | B1 * | 8/2010 | Bitar | F41H 11/12 102/403 |
| 7,958,809 | B1 * | 6/2011 | Bitar | F41H 11/12 102/403 |
| 7,987,760 | B1 * | 8/2011 | Lundquist | F41H 11/12 86/50 |
| 8,004,816 | B1 * | 8/2011 | Adler | F41H 13/0012 361/232 |
| 8,240,238 | B2 * | 8/2012 | Willner | F41H 11/16 102/403 |
| 8,430,011 | B1 * | 4/2013 | Foley | F42D 5/04 102/202.7 |
| 2008/0156219 | A1 * | 7/2008 | Voss | F41H 13/0025 102/402 |

* cited by examiner

*Primary Examiner* — James S Bergin
(74) *Attorney, Agent, or Firm* — Birch, Stewart, Kolasch & Birch, LLP

(57) ABSTRACT

A system for disabling or degrading electrically initiated explosive devices includes an apparatus for inducing waveforms of varying power and duration into the leads of a bridgewire based blasting cap, thus raising the resistance to render the blasting cap inoperable without requiring detonation, and for polling or confirming electrical performance and operational status of the blasting cap. An operational methodology for neutralizing an explosive device is included.

9 Claims, 3 Drawing Sheets

Method for Disabling

METHOD AND APPARATUS FOR DISABLING A BLASTING CAP

CROSS REFERENCE TO RELATED APPLICATIONS

This application is a divisional of U.S. patent application Ser. No. 12/748,040 filed Mar. 26, 2010, which claims the benefit of U.S. Patent Application No. 61/202,682, filed Mar. 26, 2009.

FIELD OF INVENTION

The present invention relates to a method for disabling or degrading electrically initiated to explosive devices that contain a bridgewire blasting cap (BC) or detonator and an apparatus to practice the method to result in the safe and effective neutralization of the explosive device without inducing detonation. The invention is most easily applied to military and law enforcement Counter Improvised Explosive Device (C-IED) and Explosive Ordnance Disposal (EOD) activities, and has applications with ordnance lifecycle management, tactical advantage, and demilitarization.

BACKGROUND

Currently, there are many military and law enforcement situations requiring the disablement of explosive ordnance, for example, disarmament of improvised explosive devices (IED) or modified unexploded ordnance (modified UXO) encountered by military personnel during wartime scenarios or encountered by law enforcement officials in domestic environments. Further there are non-tactical and peacetime activities such as ordnance remediation and demilitarization where UXO are neutralized for safety reasons.

Current counter-IED means include forced detonation as taught by U.S. Pat. No. 7,051,636, Show, et al and U.S. Pat. No. 7,130,624, Jackson, et al; thwarting firing electronics with jammers or decoy signals as taught by U.S. Pat. No. 7,318,368, Ham, et al and U.S. Pat. No. 7,512,511, Schultz, et al; or mechanically breaking apart IED fuse mechanisms as taught by U.S. Pat. No. 6,644,166, Alexander, et al and U.S. Pat. No. 7,481,146, Weiss, et al. Non-tactical neutralization techniques include controlled burning of the explosives as taught by U.S. Pat. No. 7,501,551, Eidelman, et al and U.S. Pat. No. 7,331,268, Pangilinan, et al; contained detonation techniques as taught by U.S. Pat. No. 7,373,867 Ryan, et al; mechanical fuse removal as taught by U.S. Pat. No. 7,328,643, Goetsch, et al; chemical processes to destroy fuses as taught by U.S. Pat. No. 7,073,424, Ferrari, et al and bioremediation processes to disable explosives as taught by U.S. Pat. No. 7,077,044, Badger, et al. There are currently no known means to disable detonators without detonation, mechanical disassembly or physical impact.

Explosive devices are typically based on a bridgewire detonator, or Blasting Cap (BC) originally demonstrated by Dr. Robert Hare in 1832 and later taught by U.S. Pat. No. 991,373, Rennie & Jessen. A blasting cap (BC) is a small sensitive primary explosive device generally used to detonate a larger, more powerful and less sensitive secondary explosive (e.g. C4, dynamite). BCs are designed with specifically defined conditions that result in ignition and resultant primary detonation. Electric BCs typically contain a bridgewire that, when heated by an electric current, causes ignition and subsequent device detonation. The bridgewire is typically soldered between the BC electrodes or leads and has resistive characteristics that result in specific heating correlated to current.

The bridgewire is typically dipped in a pyrotechnic, ignition mix or spot charge that has a specific ignition point based on temperature rise, as a function of time, and as a result of resistive heating. This initial controlled ignition sets off subsequent, less sensitive explosives within the BC and subsequently the explosive ordnance. Specific current magnitudes are of primary importance to the functioning of the BC. Specifically the "max no fire current" may be defined as the greatest current that can be applied over a time specified without ignition. The "min all fire current" may be defined as the current that results in 100% ignition of a single detonator within 500 msec.

It has been suspected that certain electromagnetic interference (EMI) radiation has detrimental effects on the performance of bridgewire detonators. EMI bridgewire degradation is a suspected factor with reduced fuse and pyrotechnic reliability of shipboard munitions due to Hazards of Electromagnetic Radiation to Ordnance (HERO) effects, other high electromagnetic (EM) environments (space, battlefield), and as a result of EM qualification testing. While noticed, this factor was little understood. With further investigation we have found this degradation phenomenon to be understandable and reproducible. This investigation formed the basis for the subject invention.

The invention disclosed herein generally relates to disablement of a blasting cap (BC) of an explosive ordnance. Further, the disclosed invention relates to a method, apparatus and system for disablement of a BC without requiring physical contact, and without imparting physical impact to the target explosive device. In particular, the invention disclosed herein relates to a method, apparatus, and system for disabling a bridgewire initiator of a BC using a power application sequence to raise the resistance of the bridgewire initiator to produce an impractical firing condition for the explosive ordnance.

Current explosive ordnance neutralization systems, also commonly referred to as explosive ordnance disposal (EOD), and may involve a mechanical impact through an aimed projection of mass, e.g., a projectile, whereby the projectile hits the targeted explosive ordnance, breaking the explosive ordnance's firing mechanism prior to a detonation of the explosive ordnance. The mechanical impact explosive ordnance neutralization systems of Alexander and Weiss may create hazardous conditions both for military and law enforcement personnel during disabling of the explosive ordnance and additionally for individuals and facilities located near the explosive ordnance. These hazardous conditions may be created by collateral damage caused by shrapnel or projectiles discharged from the conventional disrupter or when the disrupter projectile hits the explosive ordnance causing the projectile and/or ordnance to break apart upon impact, or by the inadvertent causing of detonation due to mechanical disturbance. In some instances, the mechanical impact may release contaminants or harmful materials, for example, nuclear, biological or chemical contaminants, which may be contained within an explosive terrorist device. Thus, disarmament of explosive ordnance in a densely populated area may need to be handled differently from the disarmament of explosive ordnance in a remote location.

Further, a mechanical impact on the explosive ordnance may destroy evidence, for example, forensic evidence used to determine the materials used to construct the explosive ordnance or to determine the party responsible for laying the explosive ordnance.

Forced detonation techniques, whether contained (Ryan) or not (Show, Jackson) similarly produce the undesirable effects of creating hazardous conditions for personnel and facilities as well as destroying forensic evidence. Jamming and thwarting as taught by Ham and Schultz do not definitively render the detonator and explosive device inoperable. Controlled burning as taught by Eidelman and Pangilinan, mechanical fuse removal as taught by Goetsch, and chemical techniques as taught by Ferrari require physical contact with the device implying personnel hazards. Bioremediation processes as taught by Badger are not conducive to C-IED/EOD applications as they are less structured, time consuming, and do not result in a definitive neutralized state in a process controlled manner.

Current explosive ordnance neutralization systems may also involve robotic devices used to remove the explosive ordnance from a densely populated area for detonation in a remote location. However, such explosive ordnance neutralization systems may still create hazards both to the robotic device transporting the explosive ordnance to the remote location and further to individuals or facilities located within the path of transport of the "live" explosive ordnance. Robotic explosive ordnance neutralization systems may also include infrared jamming, electromagnetic "forced" detonation, or electronic jamming devices; however, none of these robotic systems have demonstrated the ability to degrade and disable a blasting cap's (BC's) bridgewire initiator, rendering the BC inoperable by causing an impractical firing condition for the explosive ordnance.

The disabling/degrading method used by itself results in no outward means to confirm success without performing physical analysis or functional testing of the device. In some applications this lack of confirmation may be acceptable. For others, there is an understandable hesitancy by users (e.g. bomb disposal technicians) to entrust the process. A complimentary polling process that ascertains bridgewire integrity in conjunction with the disabling/degrading process provides this information. There are observable trends in bridgewire parameters that change during the process of bridgewire disabling including current, impedance and temperature. There are existing technologies and methods to measure these parameters. It is the novel implementation and application of these technologies and methods in conjunction with the claimed disabling/degrading method that is claimed for the purpose of polling bridgewires, confirming their performance status, and as a control feedback parameter for the disabling/degrading technique.

Monitoring for such trends provides process status and ultimately confirms process success. The amount of power projected correlates to the power available for coupling into the bridgewire circuit, resulting in current flow through the bridgewire. Further, monitoring bridgewire current/impedance/temperature provides indications as to bridgewire integrity.

What is needed is a method, an apparatus, and a system capable of disarming the explosive ordnance without creating hazardous conditions both for military and law enforcement personnel and robotic devices disarming the explosive ordnance, and additionally for individuals and facilities located near the "live" explosive ordnance.

Further, what is needed is a method, an apparatus, and a system capable of disarming the explosive ordnance without collateral damage to preserve physical evidence used to determine the materials used to construct the explosive ordnance or to determine the party responsible for laying the explosive ordnance, and to prevent the release of contaminants or harmful materials that may be contained within the explosive ordnance.

Therefore, what is needed is a method, an apparatus, and a system capable of remotely disabling the firing mechanism of the explosive ordnance without a physical or mechanical detonation of the explosive ordnance using a power sequence waveform to disable the bridgewire initiator of the explosive ordnance's BC.

Therefore, what is needed is a method, an apparatus, and a system capable of remotely disabling the firing mechanism of the explosive ordnance without direct human or robotic contact or exposure to the explosive ordnance.

Further, what is needed is a method, an apparatus, and a system capable of remotely polling the bridgewire to assess it performance characteristics correlated to the disabling and degrading process.

SUMMARY OF INVENTION

It is, therefore, a primary object of this invention to teach a method of, and apparatus to, disable electrically actuated detonators thereby neutralizing explosive devices or ordnance without detonation. Although such method may preferably be accomplished without direct contact with the apparatus at a distance from the explosive device, it would be obvious that the methods can be accomplished similarly with the apparatus in direct contact with the detonator.

More particularly, it is an object of this invention to provide a means for disabling explosive devices without imparting physical impact, or requiring physical contact to the target explosive device. Besides preventing collateral damage from potential detonation of the device, such a method preserves forensics of IED, allows disabling of IED that might contain harmful contaminants that would be released as a result of mechanical impact, eliminates the need for explosive charges associated with mechanical impact disruption and the related complexities and safety implications to support their use.

Still more particularly, it is an object of this invention to provide a means for raising the detonator's resistance with the result that it is impractical for the device's power supply and firing circuitry to provide the current necessary for ignition and detonation. The ability to provide the all fire current necessary for detonation would thus be impractical or unreliable given the explosive device's established fire circuit and power supply design. This results in neutralization or degraded ability of the explosive device to function, depending on the mission application.

Briefly described, these and other objects of the invention are accomplished in accordance with the apparatus aspects by providing a power sequence waveform that is coupled onto the detonator's leads and induces specific currents in the bridgewire effecting the result of raised resistance. This result can be accomplished from standoff by transmitting the waveform that couples to the detonator leads and induces the currents in the bridgewire in a systematic process. This same result can be achieved through direct connection to the explosive device as long as coupling of the systematic currents in the bridgewire are similarly accomplished. Accordingly the method may be accomplished by an apparatus transmitting the logic waveform for coupling via induction or by a logic controlled power generator that directly couples a logic waveform resulting in the desired bridgewire currents.

The method and apparatus for disabling may be complimented with the fusion of a bridgewire integrity polling method and apparatus to confirm the disabled status or provide feedback information that would be advantageous in the control loop of the disabling process. Such method and apparatus may preferably be accomplished remotely although it would be apparent to one skilled in the art that the methods and apparatus can be accomplished similarly through direct contact with the detonator. While providing obvious benefits the polling method is not necessary to achieve disabling.

With these and other objects, advantages and features of the invention that may become hereinafter apparent, the nature of the invention may be clearly understood by reference to the following detailed description of the invention, the appended claims and to the several drawings herein.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
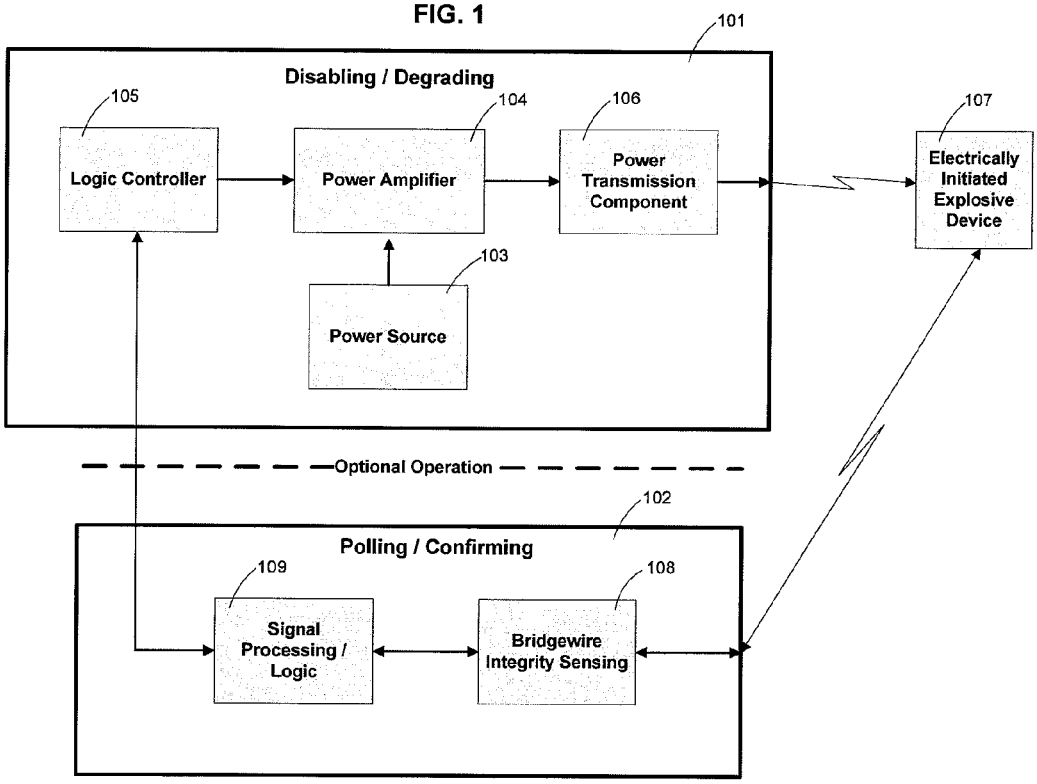
FIG. 1 is a block diagram of an apparatus to disable/degrade an electrically initiated explosive device. The top portion depicts the disabling/degrading aspects while the bottom portion depicts polling/confirming aspects.

The invention's apparatus and method degrades and disables the electrical BC of an explosive device. It degrades a BC's bridgewire by imposing a power sequence waveform that couples into and degrades the bridgewire. The bridgewire's resistance permanently increases to a point that it is impractical for the explosive device's power supply to provide the current necessary for ignition and detonation FIG. 1 depicts two primary subsystems 101 and 102 to accomplish degrading/disabling and polling/confirming functions respectively. While degrading/disabling 101 is required, polling/confirming 102 is an optional enhancement for operational and disabling control efficiency considerations.

The disabling/degrading subsystem 101 consists of a power source 103, a power amplifier 104 to attain levels suitable for transmission, a logic controller 105 to implement the necessary power waveform for disabling/degrading, and a power transmission component 106 to convey the power sequence waveform for coupling to the explosive device 107.

The disabling/degrading of the explosive device 107 may be accomplished using a direct injection of current, e.g., using direct current (DC) voltage, or a remote transmission of an electromagnetic waveform, e.g., using alternating current (AC) voltage, on BC bridgewire leads of the explosive ordnance. Preferably, the power transmission is accomplished from standoff using electromagnetic waves that induce AC waveforms. This may include electric or magnetic fields. It may also be accomplished through direct connection between the disabling/degrading subsystem 101 and the explosive device 107 and inducing current flow.

The polling/confirming subsystem 102 consists of a bridgewire integrity sensing capability 108 that obtains the status of the bridgewire. That data is processed and converted to logic by the signal processing/logic component 109 to be used by the disabling/degrading subsystem 101 for controls and end-of-process confirmation.

Figure 2:
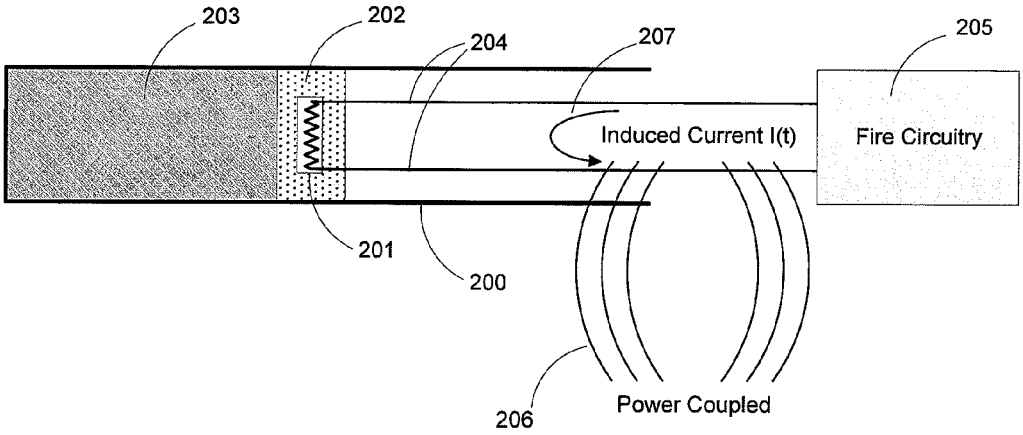
FIG. 2 depicts the power coupling method that results in current flow within the BC that results in disabling/degrading.

An explosive device may include a BC, shown in FIG. 2 that is an explosive initiator used to detonate the main charge of the explosive device. BCs were developed because of the insensitivity of explosive compounds contained within the explosive ordnance. The BC 200 may contain an easy-to-ignite primary explosive 202 that provides the initial activation energy to start a detonation in the explosive ordnance. BCs may further contain a thin bridgewire 201 in direct contact with the primary explosive, that when heated by an electric current from the fire circuitry 205 causes the ignition and subsequent detonation of the explosive ordnance. The bridgewire is typically soldered between electrodes or leads 204 and has resistive characteristics that result in specific heating correlated to current. The bridgewire is typically in contact with ignition material that has a specific ignition point based on temperature, as a function of time, and as a result of resistive heating. This initial controlled ignition sets off subsequent, less sensitive explosives 203 within the BC 200 and subsequently the explosive ordnance. Characterization of these BC current levels revealed exploitable inherent weaknesses.

The BCs functioning is defined by specific conditions that define its performance. The "max no fire current" may be defined as the greatest current that can flow through the BC bridgewire 201 over a time specified without ignition. The "min all fire current" may be defined as the current that results in 100% ignition of a single detonator within 500 msec. In the preferred embodiment, the power sequence waveform 206 couples induced current 207 to the BC 200 within the explosive device. Coupled power 206 results in current flow 207 through the bridgewire 201.

Figure 3:
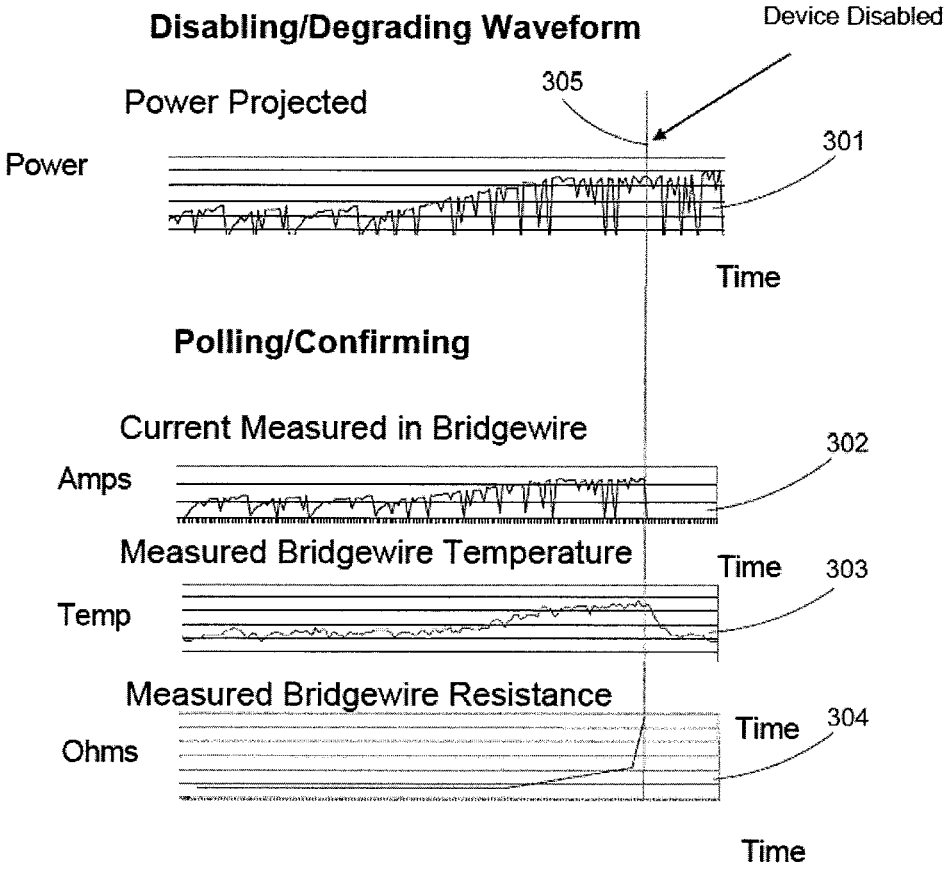
FIG. 3 depicts representations of the projected power disabling/degrading waveform correlated to the point of disabling that can be ascertained through the instrumentation and measurement of the parameters shown.

FIG. 3 depicts representations of the projected power disabling degrading waveform 301 correlated to the point of disabling that can be ascertained through the instrumentation and measurement of the parameters shown. The top portion of FIG. 3 shows a representation of the projected power disabling degrading waveform 301 correlated to the point of disabling 305. Repeated patterns of increasing and decreasing the power coupled over set time intervals, and dwelling at select power levels during the process, achieves the result of disabling 305 the detonator without tripping the fire circuit electrical components. By dwelling at these key points the bridgewire 201 is weakened, as well as the circuit conditioned, thus allowing current levels to proceed through typical "all fire" conditions without ignition. The waveform is defined and applied such that the thermal time constant of the bridgewire 201, the surrounding charge 202, and thermal system of interest remain below ever increasing conditions, a threshold shift, that would result in ignition.

For example, the Dyno Electric Super™ SP detonator is specified to have a "max no fire current" of 300 ma for 30 seconds and a "min all fire current" of 500 ma for 0.5 seconds. Initial conditioning may be a series of ramps of as long as 45 seconds and as short as 7 seconds and dwells of as long as 20 seconds and as short as 10 seconds to specific current levels initially below 300 ma and then above 300 ma. During threshold shift ramps are varied by shorter (e.g. 5 seconds) and dwells are decreased and varied (e.g. 10 seconds and less). In addition brief cooling periods are interspaced (e.g. 0.5 seconds). Current levels are initially below 500 ma and then above.

There are observable trends in bridgewire parameters that change during the process of bridgewire disabling including current 302, impedance (ohms) 304 and temperature 305.

Monitoring for such trends provides process status and ultimately confirms process success. The amount of power projected correlates to the power available for coupling into the bridgewire circuit 205, resulting in current flow through the bridgewire 201. Further, monitoring bridgewire current/impedance/temperature provides indications as to bridgewire integrity. For example, when the bridgewire is not compromised (or is active) power coupled results in current flow based on specified resistance which further results in temperature rise proportional to this current due to power dissipation. For an uncompromised bridgewire these parameters respond in a known, characterized manner. However, after the bridgewire integrity is compromised (or is inactive), current 302 or temperature 305 falls (and impedance 304 rises) even as the power available for coupling is increased. In the case of the bridgewire failing to an open circuit, a common result of the process, no current 302 will flow no matter how much power is available for coupling. Similarly impedance monitoring 304 will indicate high or open circuit conditions and temperature 303 will fall to ambient conditions as no current flow and power dissipation is occurring. As such, by monitoring current/impedance/temperature rise and fall in comparison to projected power, the failure of the bridgewire can be discerned 305. This procedure does not require detecting absolute current/impedance/temperature; rather, only relative parameter rise and fall.

For example, the detonator might experience a detectable 3° C. temperature rise above ambient during the process that quickly falls to ambient upon bridgewire failure and loss of resistive heating. Similarly the bridgewire resistance may start at 1.7 ohms and end as an open circuit at the point of failure.

Figure 4:
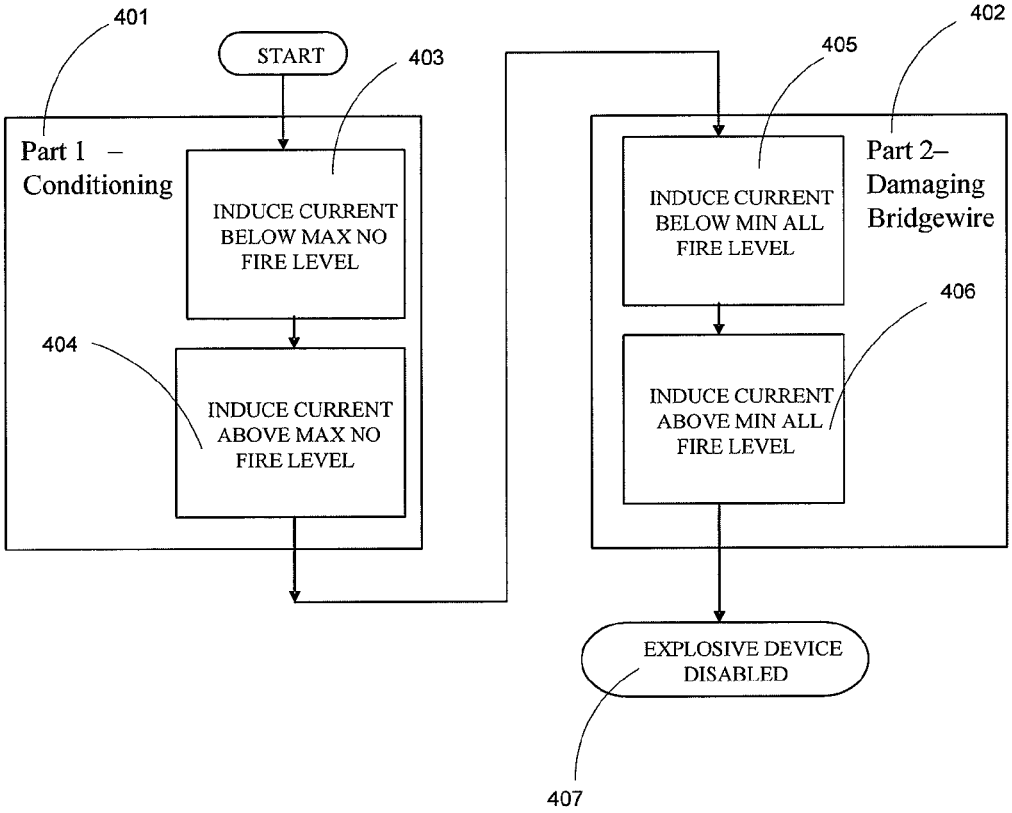
FIG. 4 is a flow diagram of a method of disabling a BC of an explosive device in accordance with an embodiment.

FIG. 4 shows the two parts 401 and 402, Part 1 and Part 2 respectively, of the disabling algorithm, which when combined result in disabling without detonation. Part 1 conditions the system such that current levels sufficient to cause a permanent threshold shift in the bridgewire can be attained without detonation. Part 2 damages the bridgewire 201, causing a threshold shift, such that current sufficient to disable it can be attained without detonation. The algorithm is comprised of a series of current ramps, dwells, and pulses interspersed with cooling periods.

An initial slow current ramp up to a dwell point near but below the maximum no fire current level rating for the item 403 allows current subsequently to be input to levels above the maximum no fire current 404 without detonation. Following successful completion of Part 1, current may be induced to a third higher level to a point below the minimum all fire current level 405 without causing detonation. Current above the minimum all fire level 406 may then be induced to complete the sequence with the final result being disabling or degrading of the bridgewire integrity 407 to a point where detonation of the BC becomes impractical or impossible with the devices' firing circuitry.

There are exploitable aspects common to all BCs. The following methods and observations apply to each device:

The method targets specific current levels above the BC's maximum no fire current level 404 where bridgewire resistance change activity increases markedly during dwell periods.

The method implements techniques of stopping a dwell period and repeating the process at specific current levels to stress the detonator without the device acquiring firing conditions.

The method interspaces brief cool periods with ramp and dwell steps to stress the device while avoiding firing due to thermal output.

The method may monitor a drop in resistance during a dwell period that is a precursor to disabling.

It should be noted that the embodiments illustrated here are merely examples of the invention. Scalable aspects of the technique include power, frequency, and electromagnetic (EM) field type (electric field, magnetic field) and accordingly drive the applications, its architecture, and operations. For example a high frequency device might be used to project a concentrated beam while a low frequency device might be used to penetrate typical attenuating obstructions found in the environment. Similarly an electric field might be used for applications requiring standoff distance while a magnetic field might be used for very close standoff distances. The transmitted power sequence waveform may be increased to improve standoff distances or to overcome attenuation. AC or DC waveforms may be directly coupled to the device or the BC leads for device test or render safe procedures.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention. Thus, the breadth and scope of the invention should not be limited by any of the above-described exemplary embodiments.

What is claimed is:

1. An apparatus for disabling an explosive device which contains a detonator comprising a bridgewire of certain resistance, and is initiated by a minimum all-fire threshold current provided by firing circuitry, the apparatus comprising:

a power source for generating a power sequence waveform having a magnitude and duration;

a power amplifier for achieving a desired power sequence waveform level;

a logic controller for implementing the power sequence waveform appropriate for disabling the detonator in the explosive device, wherein the logic controller varies the magnitude and duration of the power sequence waveform;

a power transmission member for conveying the power sequence waveform to the explosive device to be disabled, such that the power sequence waveform is coupled to the detonator thereby inactivating the detonator and disabling the explosive device; and a detonator integrity sensing member that polls whether the detonator is in an active status or an inactive status.

2. The apparatus of claim 1, wherein the sensing member monitors (i) temperature fluctuations of a bridgewire in the detonator (ii) impedence fluctuations of a bridgewire in the detonator, (iii) voltage fluctuations across a bridgewire of the detonator, or (iv) current of a bridgewire in the detonator relative to an amount of power available to be coupled into the bridgewire, thereby indicating whether the detonator is disabled.

3. The apparatus of claim 1, wherein the sensing member uses magnetic waveforms to poll a bridgewire on the detonator, thereby indicating whether the detonator is disabled.

4. The apparatus of claim 1, further comprising feedback means for relaying information regarding the activation status of the detonator to the logic controller.

5. The apparatus of claim 1, wherein the detonator is inactivated by raising the resistance of the detonator bridgewire such that the threshold current is unobtainable through the firing circuitry.

6. The apparatus of claim 1, wherein the power sequence waveform is a direct electrical current, an alternating electrical current, or an electromagnetic wave.

7. The apparatus of claim 1, wherein the power sequence waveform is coupled to the detonator remotely.

8. The apparatus of claim 1, wherein the detonator is inactivated and the explosive device is disabled without detonation.

9. The apparatus of claim 1, wherein reflection and absorption losses are minimized by adjusting operating frequency, projected power, or by utilizing magnetic wave forms.

* * * * *